US006997700B2

(12) United States Patent
Kim

(10) Patent No.: US 6,997,700 B2
(45) Date of Patent: Feb. 14, 2006

(54) LIGHTER AND METHOD OF USE

(75) Inventor: Jung Tae Kim, Incheon (KR)

(73) Assignee: Colibri Corporation, Providence, RI (US)

( * ) Notice: Subject to any disclaimer, the term of this patent is extended or adjusted under 35 U.S.C. 154(b) by 0 days.

(21) Appl. No.: 10/656,845

(22) Filed: Sep. 5, 2003

(65) Prior Publication Data

US 2005/0053880 A1 Mar. 10, 2005

(51) Int. Cl.
*F23D 11/36* (2006.01)

(52) U.S. Cl. ..... 431/153; 431/255

(58) Field of Classification Search ..... 431/153, 431/255

See application file for complete search history.

(56) References Cited

U.S. PATENT DOCUMENTS

| | | | | |
|---|---|---|---|---|
| 4,273,528 | A | 6/1981 | Gobelt | |
| 4,292,021 | A | 9/1981 | Miyagawa | |
| 4,502,465 | A | 3/1985 | Yoshinaga et al. | |
| 6,135,762 | A * | 10/2000 | Hu | 431/153 |
| 6,241,511 | B1 * | 6/2001 | Hsu | 431/255 |
| 6,663,383 | B2 * | 12/2003 | Jon | 431/153 |
| D484,742 | S | 1/2004 | Kim | |
| 6,722,877 | B2 * | 4/2004 | Wang et al. | 431/153 |
| 6,739,867 | B2 * | 5/2004 | Puig-Gros | 431/153 |
| 2003/0143504 | A1 * | 7/2003 | Chung | 431/153 |

FOREIGN PATENT DOCUMENTS

| | | |
|---|---|---|
| KR | 20-0296156 | 11/2002 |

* cited by examiner

*Primary Examiner*—Jiping Lu
(74) *Attorney, Agent, or Firm*—Salter & Michaelson

(57) ABSTRACT

An igniting lighter for a barbecue preparation apparatus is disclosed, in which a safety device is naturally unlocked by the fingers of the igniting person during an ignition of the barbecue preparation apparatus, and the safety device is automatically locked after the ignition. In the igniting lighter of the present disclosure, the safety button elastically supported by a spring is disposed at a rear of an igniting button, and therefore, the safety button is pressed naturally by an indicating finger when pressing the igniting button with a thumb, whereby the safety device is naturally unlocked when igniting, and is automatically locked upon finishing the ignition.

22 Claims, 5 Drawing Sheets

LIGHTER AND METHOD OF USE

BACKGROUND

1. Technical Field

The present application is directed to a lighter and method of use and, in particular, to a lighter with a safety device to prevent inadvertent ignition of the lighter and a method of using the lighter.

2. Related Art

Many safety devices have been proposed to prevent inadvertent lighting of lighters, in particular by children. One such lighter is described in Korean Utility Model Registration 239686, which discloses an igniting lighter with a safety device provided at one side of an ignition button. In order to ignite the lighter, the safety device first must be unlocked, followed by depressing the ignition button. However, the safety device can be unlocked only by an intentional manipulation when carrying out the ignition. Further, after the ignition, the safety device has to be locked by an intentional manipulation. This can be inconvenient and more importantly, easily forgotten when a user is busy, defeating the purpose of having a safety lock.

Thus, there is need in the art for a lighter with an automatic safety feature to further decrease the possibility of inadvertent lighting, providing increased safety to users, especially children.

SUMMARY

The present disclosure is directed to an ignition lighter particularly adapted as a barbecue-style lighter, in which the safety device is naturally unlocked by the fingers of the igniting person during an ignition of the barbecue preparation apparatus, and the safety device is automatically locked after the ignition.

According to the disclosure, the ignition lighter includes a safety device such that in use, the index finger supports the rear part of the lighter, and the safety button is disposed correspondingly to the index finger. Thus, when the ignition button is pushed by a user's thumb, the safety button is easily and naturally pressed in order to unlock the safety device, rendering ignition easier.

In one embodiment, the lighter includes a housing, and an ignition button and a safety button extending through and supported by the housing. The lighter also includes a biasing member operatively connected to the safety button and to a fuel source, and an actuating member operatively connected to the ignition button and to an ignition source. When a force is exerted on both the ignition button and the safety button, the fuel source is opened and the ignition source is activated to light the lighter, and when the force on the ignition and safety buttons is released, the fuel source is closed, the ignition source is de-activated, and the safety button automatically returns to a locked or off position.

In some embodiments, the actuation member includes a first actuating arm and a second actuating arm disposed angularly to the first, which is interlocked to the ignition button and constructed and arranged to be engaged to or disengaged from an engaging shaft of the safety button. The second arm is constructed and arranged to actuate the piezoelectric unit.

In some embodiments the engaging shaft of the safety button extends to an up and downwardly sliding movable shaft, and a biasing member is disposed under the engaging shaft, while a projecting shaft is formed under the engaging shaft for an accurate functioning of the biasing member.

Some embodiments includes a separating wall to ensure that the engaging shaft moves vertically so that the biasing member is accurately seated.

The foregoing and other objects, features and advantages of the disclosure will be apparent from the following more particular description of preferred embodiments of the disclosure, as illustrated in the accompanying drawings in which like reference characters refer to the same parts throughout the different views. The drawings are not necessarily to scale, emphasis instead being placed upon illustrating the principles of the disclosure. The principles and features of this disclosure may be employed in varied and numerous embodiments without departing from the scope of the disclosure.

BRIEF DESCRIPTION OF THE DRAWINGS

The above object and other advantages of the present disclosure will become more apparent by describing in detail the preferred embodiment of the present disclosure with reference to the attached drawings in which.

DETAILED DESCRIPTION OF THE PREFERRED EMBODIMENT

Figure 1:
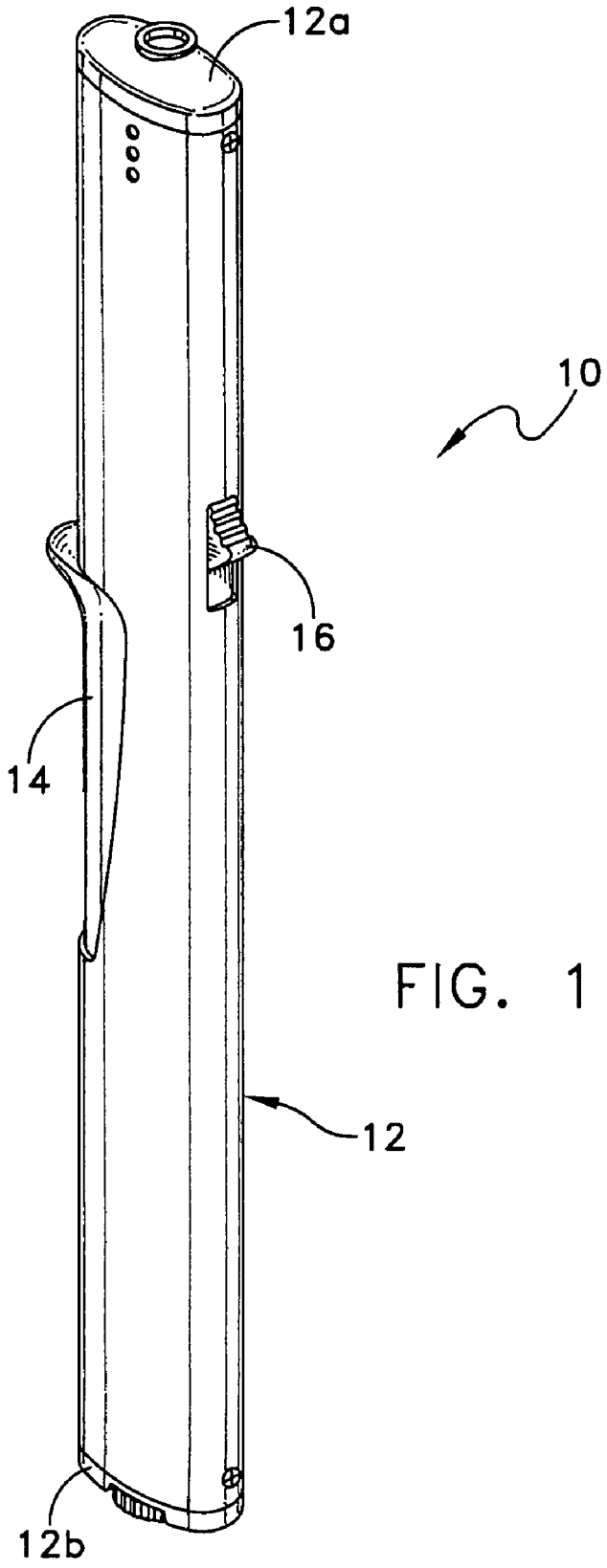
FIG. 1 is a perspective view of an exemplary lighter according to the present disclosure.
Figure 2:
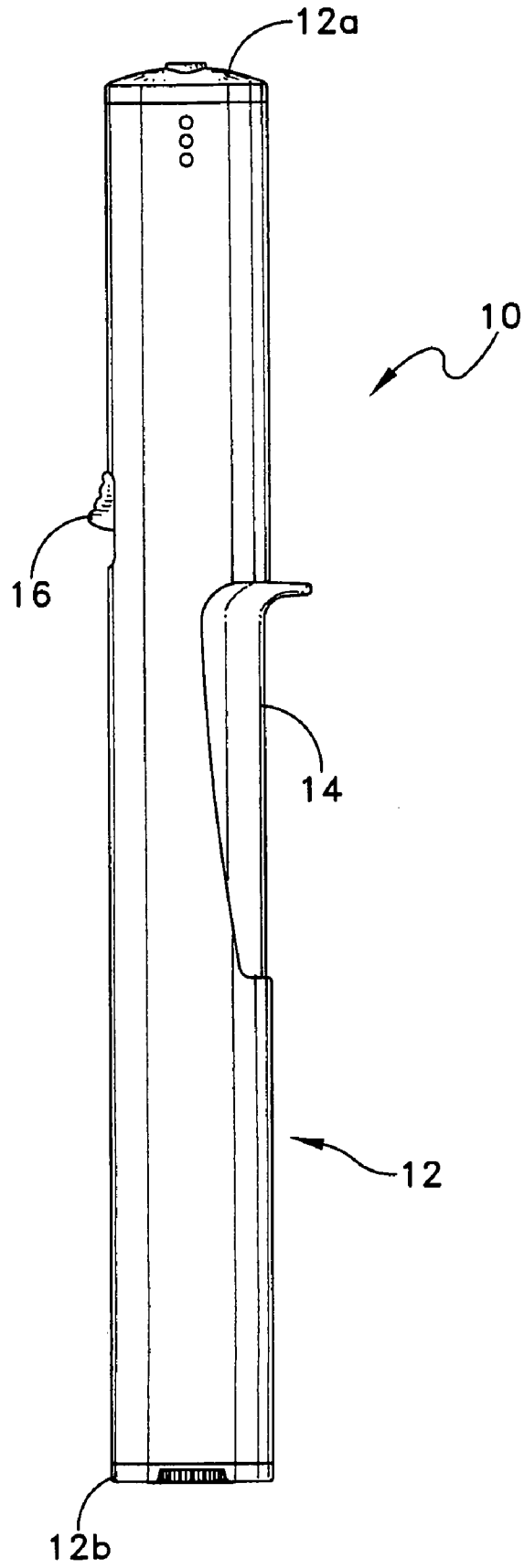
FIG. 2 is a side view of the exemplary lighter shown in FIG. 1.

FIGS. 1 and 2 show one exemplary embodiment of a lighter 10 according to the present disclosure. As shown, lighter 10 has a longitudinal housing 12 with an upper ignition end 12*a* and a lower end 12*b* opposite upper end 12*a*. An ignition button 14 and a safety button 16 both are supported by and extend through housing 12 between the opposing ends 12*a,b*. In a lighter according to the present disclosure, ignition button 14 and safety button 16 are located in positions natural to where a hand would grasp the lighter and therefore, the locking and unlocking of the safety device are automatically and naturally carried out, thereby rendering the use of the lighter more convenient.

Figure 3:
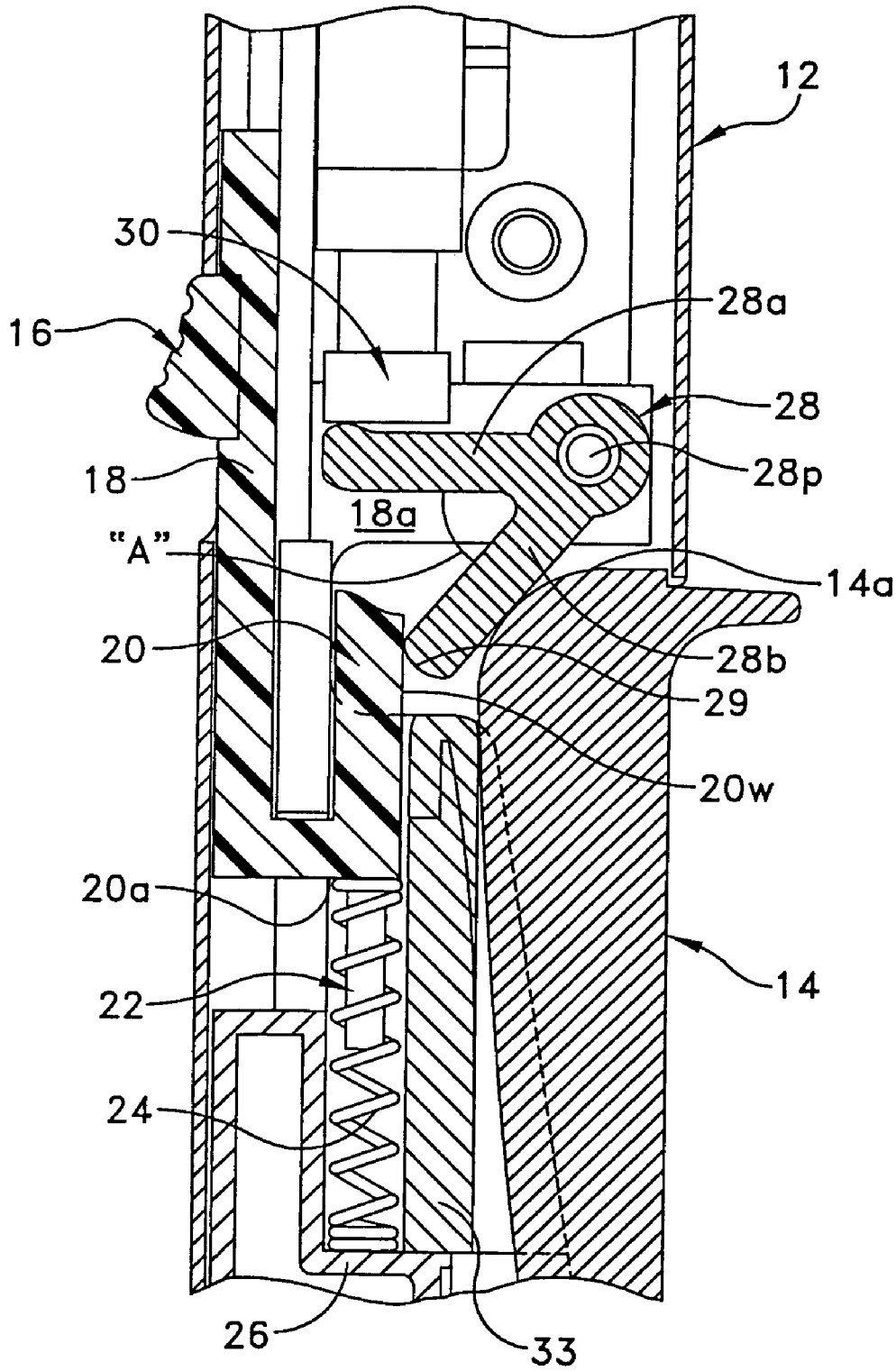
FIG. 3 is and enlarged sectional view of a portion of the lighter shown in FIGS. 1 and 2 showing the safety button of the lighter in a locked or off position.

As shown in FIG. 3, safety button 16 is supported on a moveable shaft 18 positioned inside and adjacent to housing 12. Moveable shaft 18 is operably connected to and substantially parallel to an engaging shaft 20, from which a projecting shaft 22 extends downwardly. A biasing member 24 which, in the present embodiment, is a coiled elastic spring, is positioned on projecting shaft 22 in between an underside 20*a* of engaging shaft 20 and an interior support structure 26, which acts as a spring seat. A separating wall 33 is positioned between engaging shaft 20 and ignition button 14 to ensure that engaging shaft 20 will slide downwardly in a vertical direction, and that biasing member 24 will accurately seat against support structure 26. Biasing member 24 biases ignition button 14 upwardly in a normally locked position until released manually by a user as will be explained in greater detail below.

Still referring to FIG. 3, an actuation member 28 is pivotally attached to housing 18 at a pivot point 28*p* inside housing 18. As shown, actuation member 28 may be supported on an intermediate support structure 18*a* rather than directly to the interior of housing 18. In the present embodiment, actuation member 28 is hingedly attached to support 18*a*. Actuation member 28 includes an upper actuation arm 28*a* and a lower actuating arm 28*b*, preferably positioned at an angle "A" with respect to one another, as illustrated.

FIG. 2 illustrates a locked or off position, in which biasing member 24 biases engaging shaft upwardly; actuation arm 28*a* is positioned adjacent to a piezoelectric unit 30; and actuation arm 28*b* is positioned adjacent upper end 14*a* of ignition button 14 while tip 29 of lower actuation arm 28*b* engages a sidewall 20*w* of engaging shaft 20.

Figure 4:
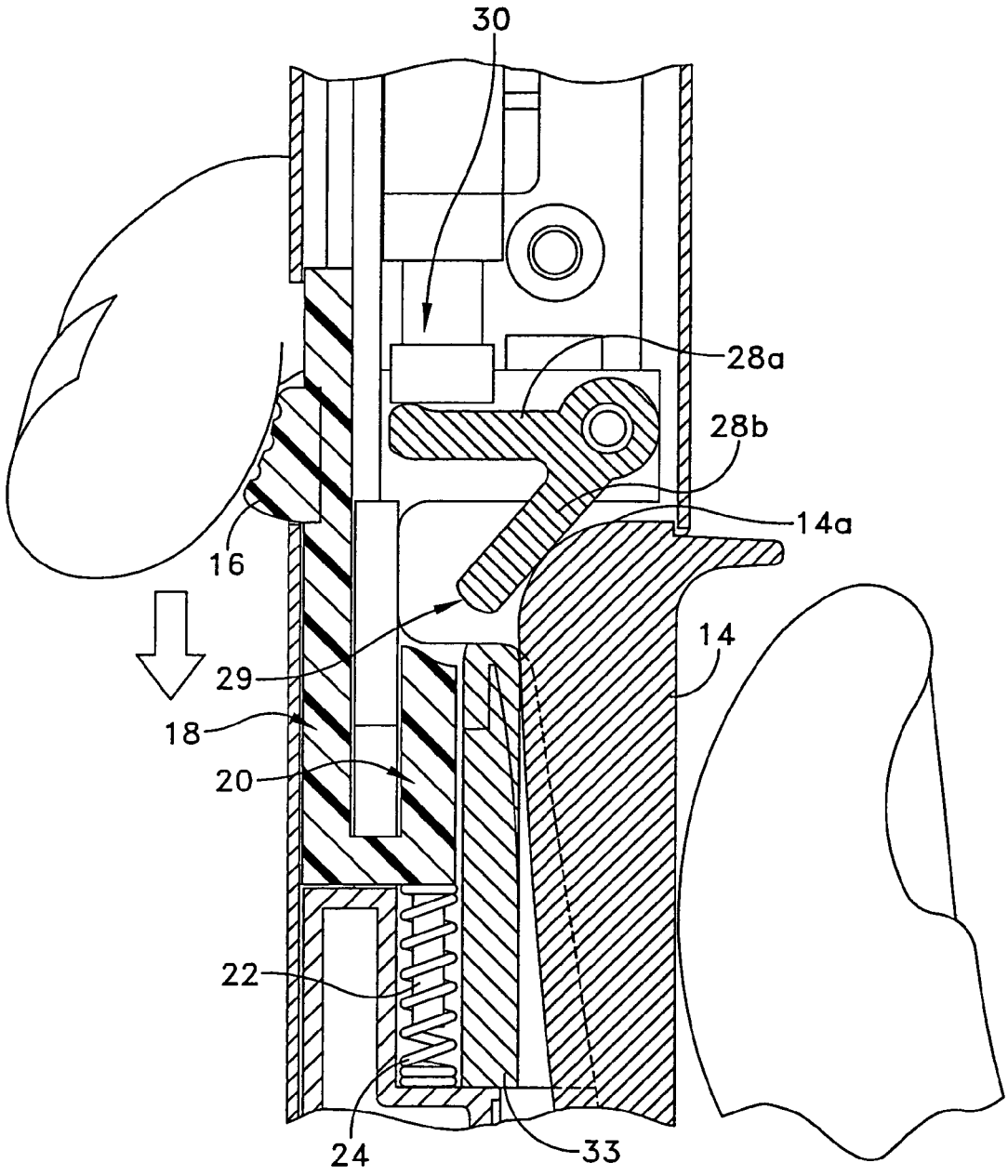
FIG. 4 is a sectional view showing a user unlocking the safety button of the lighter and pressing the ignition button.
Figure 5:
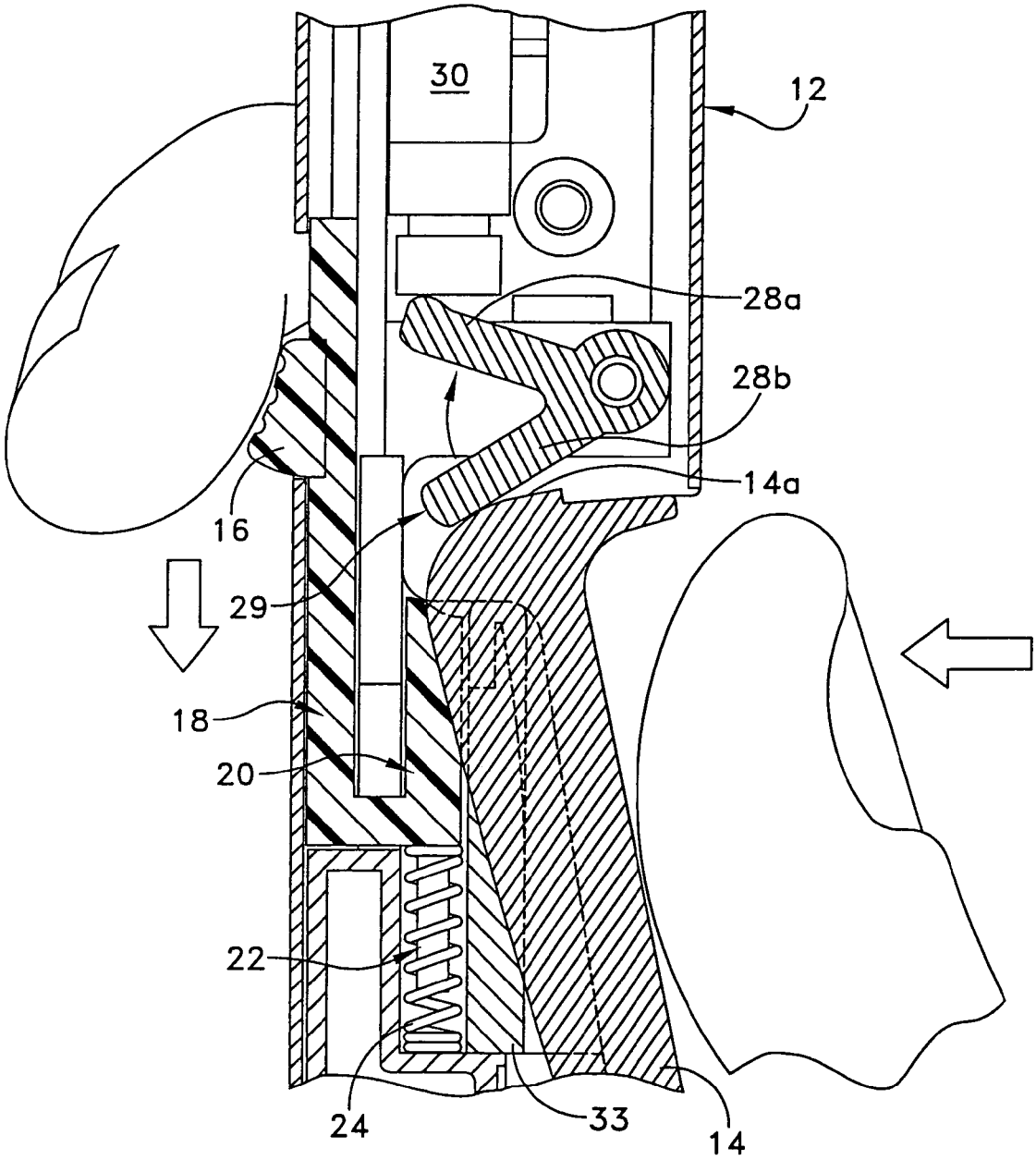
FIG. 5 is a sectional view showing a user the safety button in an unlocked position and the ignition button in a depressed position, ready to ignite a flame.

In operation, as shown in FIGS. 4–5 when taken together, a user grasps housing 18 and positions a thumb on ignition button 14, and a index finger on safety button 16 in a natural manner. The user exerts a force with the thumb to press ignition button 14, and causing the index finger to exert a downward force on safety button 16 in a natural manner, causing movable shaft 18 to move downwardly. At the same time, engaging shaft 20 moves downwardly, compressing biasing member 24. When ignition button 14 is actuated, biasing member 24 is compressed and fuel is released from a reservoir (not illustrated). In addition, when biasing member 24 is compressed and a force is being exerted on ignition button 14, actuation member 28 then may pivot about pivot point 28*p* in the direction shown in the arrow. Thus, actuation arm 28*a* moves in an upward direction, which activates piezoelectric unit 30 and causes ignition of a flame due to a spark generated by piezoelectric unit 30.

Upon release of ignition button 14, the force on safety button 16 is also released simultaneously or shortly thereafter, causing biasing member 24 to be restored to a biased position (as shown in FIG. 3) in which the discharge of fuel from the reservoir is blocked, automatically suppressing the flame. At the same time, when safety button 16 is restored to its original position, actuation arm 28*b* of actuation member 28 re-engages engaging shaft 20, thereby placing the lighter in the locked or off position shown in FIG. 3.

While this disclosure has been particularly shown and described with references to preferred embodiments thereof, it will be understood by those skilled in the art that various changes in form and details may be made therein without departing from the spirit and scope of the disclosure as defined by the appended claims.

What is claimed is:

1. A lighter with an automatic locking device, the lighter comprising:

an elongated housing having opposed sides;

an ignition button and a safety button extending through and supported by the housing;

the ignition and safety buttons being arranged on said opposed respective sides;

a biasing member operatively connected to the safety button;

an actuating member that is separately pivotally supported from yet operatively responsive to the ignition button for controlling an ignition source;

wherein, when a force is exerted on both the ignition button and the safety button, the fuel source is opened and the ignition source is activated to light the lighter, and when the force on the ignition and safety buttons is released, the fuel source is closed, the ignition source is de-activated, and the safety button automatically returns to a locked or off position wherein the safety button is supported to slide in the longitudinal direction of the housing while the ignition button is supported to pivot into the housing.

2. The lighter of claim 1 wherein the housing has upper and lower ends and the safety button is located on one side of the housing at a position that is closer to the upper end of the housing than the location of the ignition button so as to more naturally match the buttons to the hand position of the user.

3. The lighter of claim 2 wherein the safety button has a shaft that slides in the longitudinal direction and the biasing member comprises a coil spring supported at the bottom of the safety button shaft to normally urge the safety button to an upper position.

4. The lighter of claim 3 wherein said actuating member has an arm that is disposed between the safety button shaft and the ignition button to prevent actuation of the ignition button when the safety button is in its locked position.

5. The lighter of claim 4 wherein the actuating member also has a second arm that actuates the ignition source.

6. The lighter of claim 5 wherein the arms are disposed at an acute angle to each other.

7. The lighter of claim 1 wherein the actuating member is supported at a pivot point that is above the ignition button.

8. A lighter with an automatic locking device, the lighter comprising:

an elongated housing having opposed sides;

an ignition button and a safety button extending through and supported by the housing;

the ignition and safety buttons being arranged on said opposed respective sides;

a biasing member operatively connected to the safety button;

an actuating member that is separately pivotally supported from yet operatively responsive to the ignition button for controlling an ignition source;

wherein, when a force is exerted on both the ignition button and the safety button, the fuel source is opened and the ignition source is activated to light the lighter, and when the force on the ignition and safety buttons is released, the fuel source is closed, the ignition source is de-activated, and the safety button automatically returns to a locked or off position wherein the safety button is supported to slide in the longitudinal direction of the housing while the ignition button is supported to pivot into the housing said actuating member has two arms, one arm for contacting the ignition source and the other arm for engaging between the buttons to prevent actuation of the ignition button when the safety button is in its locked position.

9. The lighter of claim 8 wherein the ignition source is disposed over said one arm.

10. A lighter with an automatic locking device, the lighter comprising:

a longitudinal housing having upper and lower ends and one and another opposed side walls;

an ignition button extending through and supported by said housing disposed between said upper and lower ends and arranged on said one side wall of said housing;

a safety button extending through and supported by said housing disposed between said upper and lower ends and arranged on said another side wall of said housing;

a biasing member operatively connected to the safety button to normally bias the safety button to a locked position;

an actuating member operatively connected to the ignition button and to an ignition source;

said actuating member being independently pivotally supported adjacent said ignition and safety buttons;

said actuating member having an arm that is urged by said ignition button to an igniting position when said safety button is at its released position and blocks said ignition button when said safety button is in its locked position;

wherein, when a force is exerted on both the ignition button and the safety button, the ignition button is free to move to its ignition position, and when the force on the ignition and safety buttons is released, the safety button automatically returns to its locked position wherein the safety button is supported to slide in the longitudinal direction of the housing while the ignition button is supported to pivot into the housing.

11. The lighter of claim 10 wherein the safety button is located on one side of the housing at a position that is closer to the upper end of the housing than the location of the ignition button so as to more naturally match the buttons to the hand position of the user.

12. The lighter of claim 10 wherein the safety button has a shaft that slides in the longitudinal direction and the biasing member comprises a coil spring supported at the bottom of the safety button shaft to normally urge the safety button to an upper position.

13. The lighter of claim 12 wherein said actuating member has an arm that is disposed between the safety button shaft and the ignition button to prevent actuation of the ignition button when the safety button is in its locked position.

14. The lighter of claim 13 wherein the actuating member also has a second arm that actuates an ignition source.

15. The lighter of claim 14 wherein the arms are disposed at an acute angle to each other.

16. The lighter of claim 10 wherein the actuating member is supported at a pivot point that is above the ignition button.

17. The lighter of claim 16 the actuating member has two arms, one arm for contacting the ignition source and the other arm for engaging between the buttons.

18. The lighter of claim 17 wherein the ignition source is disposed over said one arm.

19. The lighter of claim 10 wherein the safety button is normally biased to an upper position and is manually operated to a lower position.

20. A lighter with an automatic locking device, the lighter comprising:

a longitudinal housing having upper and lower ends and one and another opposed side walls;

an ignition button extending through and supported by said housing disposed between said upper and lower ends and arranged on said one side wall of said housing;

a safety button extending through and supported by said housing disposed between said upper and lower ends and arranged on said another side wall of said housing;

a biasing member operatively connected to the safety button to normally bias the safety button to a locked position;

an actuating member operatively connected to the ignition button and to an ignition source;

said actuating member being independently pivotally supported adjacent said ignition and safety buttons;

said actuating member having an arm that is urged by said ignition button to an igniting position when said safety button is at its released position and blocks said ignition button when said safety button is in its locked position;

wherein, when a force is exerted on both the ignition button and the safety button, the ignition button is free to move to its ignition position, and when the force on the ignition and safety buttons is released, the safety button automatically returns to its locked position wherein the safety button is supported to slide in the longitudinal direction of the housing while the ignition button is supported to pivot into the housing;

wherein the safety button is located on one side of the housing at a position that is closer to the upper end of the housing than the location of the ignition button so as to more naturally match the buttons to the hand position of the user; wherein the safety button is supported to slide in the longitudinal direction of the housing while the ignition button is supported to pivot into the housing; wherein the safety button has a shaft that slides in the longitudinal direction and the biasing member comprises a coil spring supported at the bottom of the safety button shaft to normally urge the safety button to an upper position; wherein said actuating member has an arm that is disposed between the safety button shaft and the ignition button to prevent actuation of the ignition button when the safety button is in its locked position; wherein the actuating member also has a second arm that actuates an ignition source; wherein the ignition source is disposed over said second arm; wherein the safety button is normally biased to an upper position and is manually operated to a lower position; wherein a separating wall is disposed between the actuating member shaft and the ignition button; and wherein the ignition button has a rounded upper end that engages with said one arm.

21. A lighter with an automatic locking device, the lighter comprising:

an elongated housing having opposed sides;

an ignition button and a safety button, both supported by the housing;

the ignition and safety buttons being arranged on said opposed respective sides;

a biasing member operatively connected to the safety button;

an actuating member that is operatively responsive to the ignition button for controlling an ignition source;

a pivot for pivotally supporting said actuating member;

wherein, when both the ignition button and the safety button are operated, the actuating member is in a first position enabling the operation of the ignition button to activate the ignition source, and when the ignition button and the safety button are both released the actuating member pivots to a second position to re-engage the safety button, thereby placing the lighter in the locked or off position wherein the safety button is supported to slide in the longitudinal direction of the housing wile the ignition button is supported to pivot into the housing.

22. The lighter of claim 21 wherein the safety button has a shaft that slides in the longitudinal direction and the actuating member has one arm that is disposed between the safety button shaft and the ignition button to prevent actuation of the ignition button when the safety button is in its locked position, and another arm for contacting the ignition source.

* * * * *